US010413096B2

(12) United States Patent
Bacallao

(10) Patent No.: US 10,413,096 B2
(45) Date of Patent: Sep. 17, 2019

(54) TRASH BIN CABINET FOR A CHECKOUT STATION

(71) Applicant: Walmart Apollo, LLC, Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/913,306

(22) Filed: Mar. 6, 2018

(65) Prior Publication Data

US 2018/0255943 A1 Sep. 13, 2018

Related U.S. Application Data

(60) Provisional application No. 62/468,221, filed on Mar. 7, 2017.

(51) Int. Cl.
*A47B 88/919* (2017.01)
*A47F 9/04* (2006.01)
(Continued)

(52) U.S. Cl.
CPC ..... *A47F 9/04* (2013.01); *A47B 88/00* (2013.01); *A47B 88/919* (2017.01);
(Continued)

(58) Field of Classification Search
CPC ..... A47B 88/00; A47B 88/50; A47B 88/919; A47F 9/04; E05C 1/002; E05C 1/04; B65F 1/1426; Y10T 292/0969; Y10T 292/0997
(Continued)

(56) References Cited

U.S. PATENT DOCUMENTS 48,717 A * 7/1865 Potter
82,863 A * 10/1868 Munson et al.
(Continued)

FOREIGN PATENT DOCUMENTS

CN 2383813 Y 6/2000
CN 203033243 U 7/2013
(Continued)

OTHER PUBLICATIONS

"Hon 4 drawer vertical file cabinet w/push button locks," Eugene. Craigslist.org, posted Jan. 3, 2017.

*Primary Examiner* — James O Hansen
(74) *Attorney, Agent, or Firm* — Schmeiser, Olsen & Watts LLP; Karen E. Jachimowicz

(57) ABSTRACT

A trash bin cabinet for a checkout station in a retail store is described. The checkout station includes the trash bin cabinet with a drawer locking mechanism, and a trash level sensor with an optical notification system. The trash bin cabinet has a drawer unit that contains at least one trash bin. The drawer locking mechanism locks the drawer when the drawer unit is closed so the drawer unit does not come open by itself and become a hazard or a nuisance. The trash level sensor senses the level of trash in the trash bins and sends a trash level status signal to the optical notification system. The optical notification system optically radiates the trash level status signal so people or sensors can monitor the level of trash in the trash bins without visiting the checkout station.

16 Claims, 9 Drawing Sheets

(51) Int. Cl.

| | |
|---|---|
| ***B65F 1/14*** | (2006.01) |
| ***E05C 1/00*** | (2006.01) |
| ***E05C 1/04*** | (2006.01) |
| ***A47B 88/00*** | (2017.01) |

(52) U.S. Cl.
CPC ..... *B65F 1/1426* (2013.01); *E05C 1/002* (2013.01); *E05C 1/04* (2013.01); *A47F 2009/041* (2013.01); *B65F 2210/128* (2013.01); *B65F 2210/148* (2013.01); *B65F 2210/1443* (2013.01)

(58) Field of Classification Search
USPC ..... 312/330.1, 333, 319.1, 270.2, 270.3
See application file for complete search history.

(56) References Cited

U.S. PATENT DOCUMENTS 654,922 A * 7/1900 Schipkowsky
766,198 A * 8/1904 Reilly
1,394,513 A * 10/1921 Albonesi ..... E05B 65/0864 292/60
2,019,455 A * 10/1935 Lehman ..... A47B 17/02 312/196
3,666,338 A * 5/1972 Russell ..... E05B 65/0014 206/1.5
4,838,626 A * 6/1989 Parr ..... E05B 65/46 292/153
5,593,192 A * 1/1997 Stuchinsky ..... E05B 17/0037 292/163
5,634,702 A * 6/1997 Fistonich ..... A47B 77/18 312/270.3
5,938,305 A * 8/1999 Rubsam-Tomlinson ..... A47B 81/00 220/909
6,367,377 B1 4/2002 Gawley et al.
7,500,429 B2 3/2009 Willamor
2007/0257588 A1* 11/2007 Chen ..... E05B 63/248 312/333
2008/0284292 A1* 11/2008 Castelluccio ..... A47B 85/08 312/107
2015/0323366 A1 11/2015 Kekalainen et al.

FOREIGN PATENT DOCUMENTS

CN 103847121 A 6/2014
CN 104309969 A 1/2015

* cited by examiner

TRASH BIN CABINET FOR A CHECKOUT STATION

CROSS REFERENCE TO RELATED APPLICATION

This invention claims priority to U.S. provisional patent application Ser. No. 62/468,221, filed Mar. 7, 2017 to Applicant Wal-Mart Stores Inc., and entitled "Collectible Bin Cabinet and Level Reporting System for a Checkout Station", which is incorporated entirely herein by reference.

BACKGROUND OF THE INVENTION

Technical Field

This invention relates to trash and collection bins at checkout stations in a retail store, and specifically to a trash bin cabinet with a drawer locking mechanism.

State of the Art

Checkout stations in retail stores often include trash and/or collection bins to collect trash, recyclables, hangers, boxes, or other items that are collected at a checkout station. Checkout stations in retail stores are where customers pay for and bag their purchases. Trash bins are buckets or baskets that hold trash. Collection bins can collect trash or other collectible items such as recyclables, hangers, etc. Trash and collection bins that are not stored in a cabinet may be knocked over and look messy. Bins are sometimes put in an unlocked cabinet at the checkout station, but the cabinet can be left open or can fall open, creating a work hazard. Sometimes it is desirable to lock the bin cabinet so that only employees can access the trash or collectible bins. In addition, a trash or collection bin that is inside a cabinet may overflow with trash or collectibles if it not checked often enough. What is needed is a locking cabinet for containing trash and collection bins at a checkout station. Also, a level sensor is needed that checks the level of trash or collectibles in the bins and reports on the level so that trash and collectible bins do not overflow.

DETAILED DESCRIPTION OF EMBODIMENTS OF THE INVENTION

As discussed above, embodiments of the present invention relate to trash and collection bins at checkout stations in a retail store, and specifically to a trash bin cabinet with a drawer locking mechanism.

Disclosed is a checkout station in a retail store that includes a trash and collectible bin cabinet, a trash or collectible level sensor, and an optical notification system. The trash and collectible bin cabinet holds at least one bin for collecting trash or other collectables at the checkout station. The trash bin cabinet has a drawer locking mechanism to lock the trash and collectible bin cabinet drawer unit closed so the cabinet drawer unit does not fall open and become a hazard at the checkout station. The level sensor automatically measures the level of trash or collectibles in the bins, and provides a trash or collectible level status signal that can be used to remotely determine the level of items in the bins. The optical notification system can be used to optically radiate the level status signal. The optical notification system can include a light emitter, such as on a light pole above the checkout station. The light emitter can optically radiate the level status signal, using either visible or non-visible light, so that a person or an optical sensor can receive the level status signal and be advised of the level of trash or other items in the bins.

Disclosed is a trash bin cabinet that includes a cabinet housing, a drawer unit that pulls out from the cabinet and contains at least one bin for collecting trash or other collectibles, and a drawer locking mechanism for locking the drawer unit in the closed position. The drawer locking mechanism includes a pin housing with a pin and a spring enclosed in the housing, and an ear. The pin housing is coupled to an outer surface of the cabinet housing. The spring is coupled to the pin and the pin housing such that the pin retractably extends through a pin hole in the cabinet housing. An ear with an ear hole is coupled to the drawer unit such that the ear hole lines up with the pin hole when the drawer unit is closed. The drawer unit is locked closed when the pin extends through the pin hole and the ear hole. The pin can be easily retracted from the ear hole and the pin hole to open the drawer unit to access the bin. The drawer locking mechanism keeps the drawer unit from opening on its own and causing a hazardous or messy condition.

Figure 1:
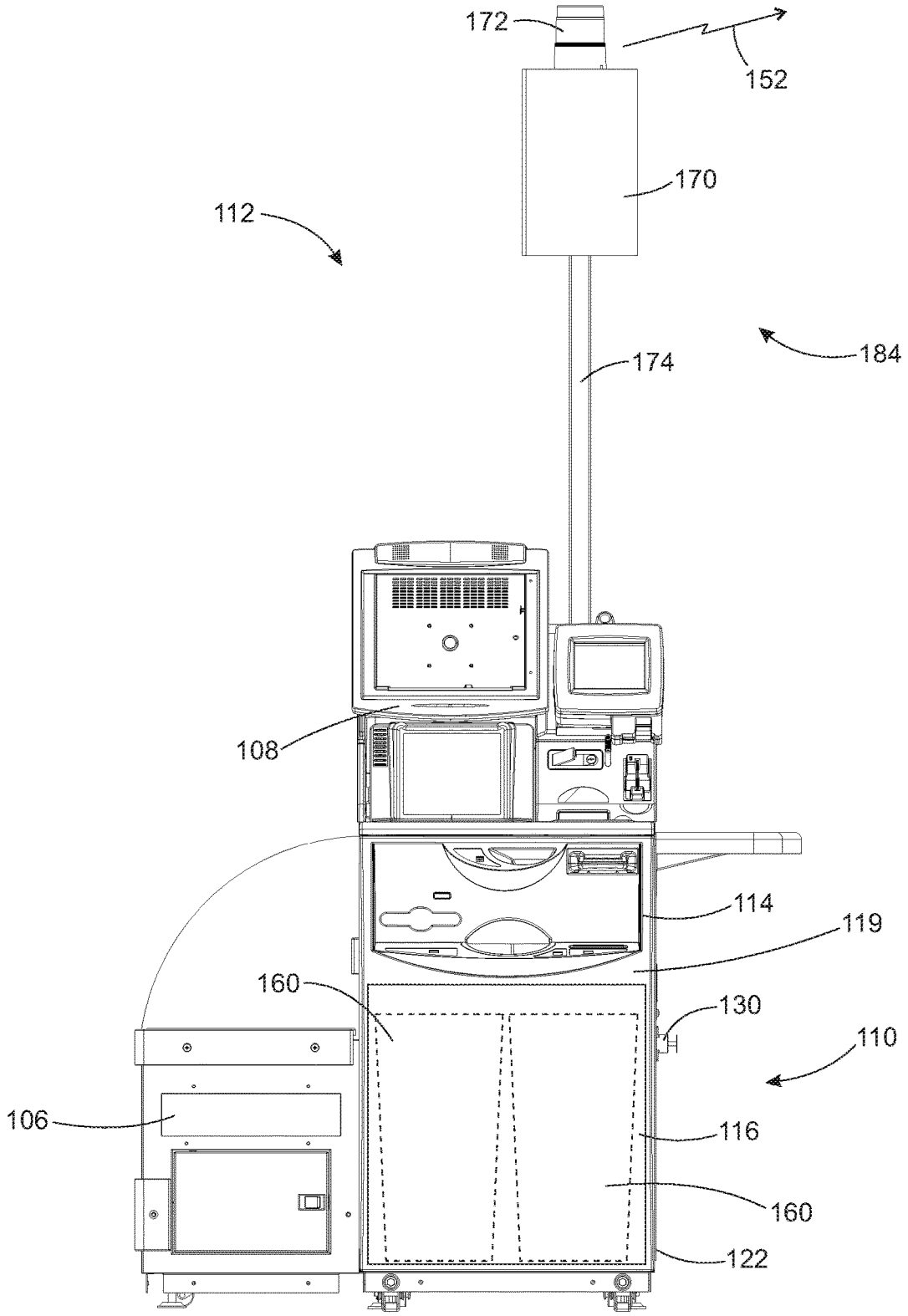
FIG. 1 shows front view of a checkout station in a retail store with a trash bin cabinet, a level sensor, and an optical notification system.
Figure 2:
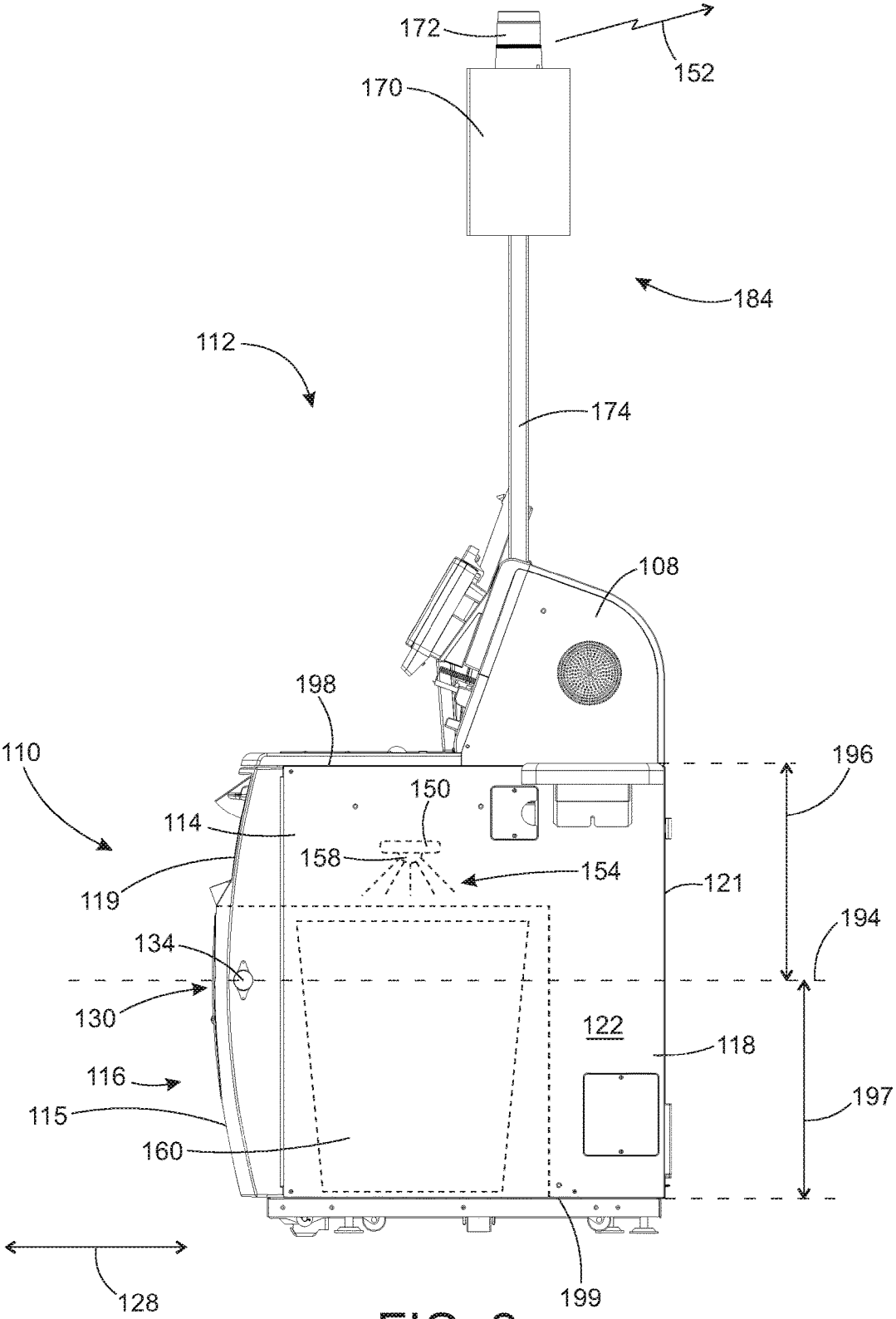
FIG. 2 shows a side view of the checkout station of FIG. 1 with the trash bin cabinet, level sensor, and optical notification system.
Figure 3:
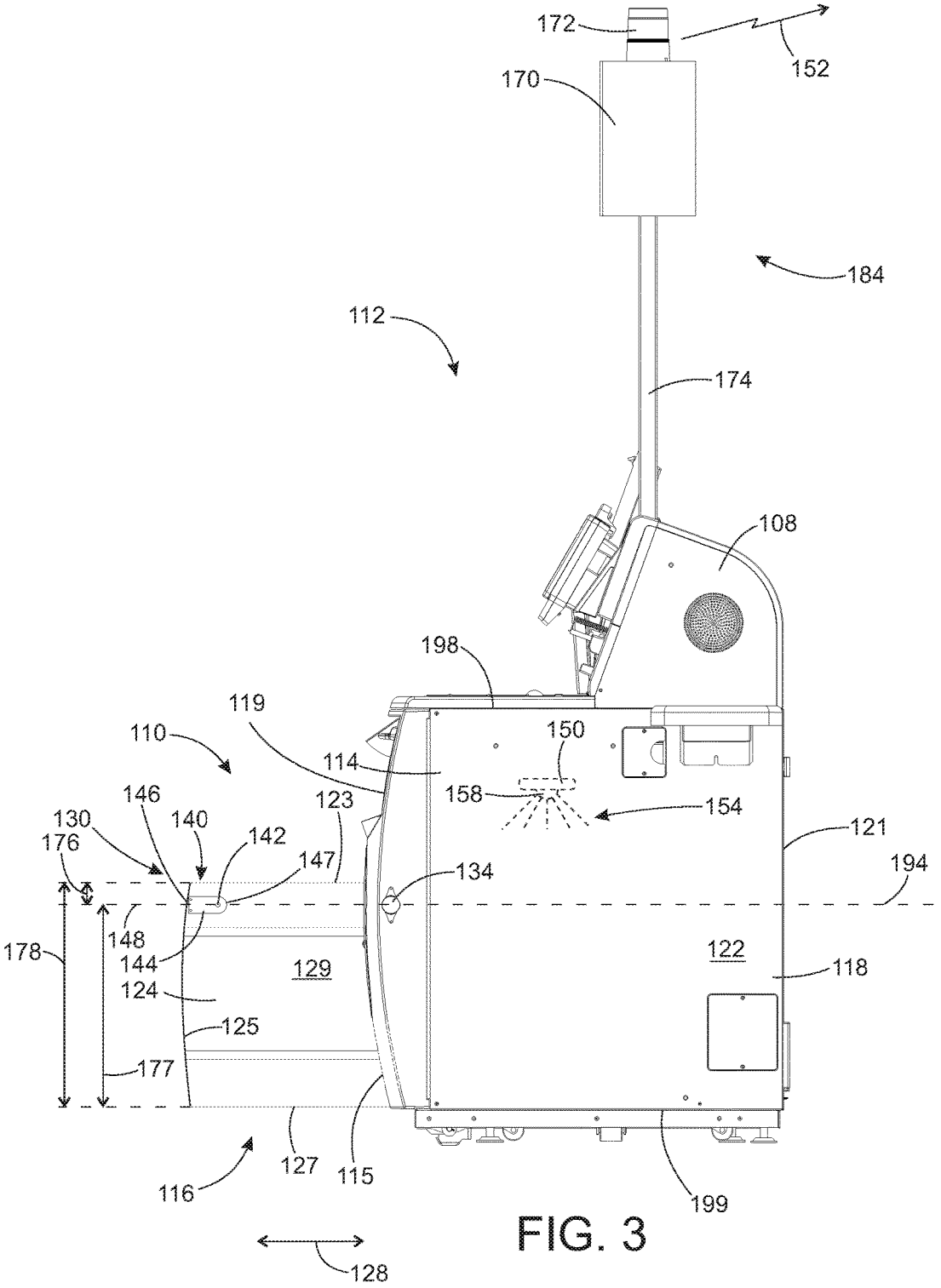
FIG. 3 shows a side view of the checkout station of FIG. 1 with a drawer unit of the trash bin cabinet pulled open.

FIG. 1, FIG. 2, and FIG. 3 show a checkout station 112 in a retail store. FIG. 1 shows a front view of checkout station 112. FIG. 2 shows a side view of checkout station 112. FIG. 3 shows a side view of checkout station 112 with a drawer unit 116 pulled partially open. Checkout station 112 is a self-checkout station 112 in this embodiment, but this is not mean to be limiting. In some embodiments, checkout station 112 is an employee-run checkout station. Checkout station 112 is where customers bring their items to be purchased and bagged. Checkout station 112 can take many different forms. Checkout station 112 includes a trash bin cabinet 110 that supports a cash register 108 and encloses equipment and electronics for checkout station 112. Trash bin cabinet 110 has a cabinet housing 114 enclosing drawer unit 116 with at least one trash bin 160. Cash register 108 and scale 106 for weighing purchases are both coupled to cabinet housing 114.

Checkout station 112 also includes an optical notification system 184 coupled to trash bin cabinet 110. Optical notification system 184 includes a light pole 174 with a light fixture 170 and light emitter 172. Optical notification system 184 uses light emitter 172 to provide visible or invisible light communications and status indicators. Light emitter 172 can indicate whether checkout station is open or closed, for example, or can indicate that a manager is needed at the checkout station, as another example. In this embodiment, optical notification system 184 and light emitter 172 are used to indicate the status of bins 160 used to collect trash or other items at checkout station 112, as explained herein. In some embodiments, checkout station 112 does not include optical notification system 184.

Trash bin cabinet 110 holds at least one trash bin 160. In this embodiment, trash bin cabinet 110 holds two trash bins 160. Trash bin cabinet 110 in this embodiment holds trash bins, but it is to be understood that trash bin cabinet 110 can be a collectible cabinet that hold bins for trash or bins for other collectibles such as recyclables, hangers, boxes, or any other items that may be collected at checkout station 112. In some embodiments, trash bins 160 are collectible bins for other types of collectibles.

Trash bin cabinet 110 includes cabinet housing 114, drawer unit 116, a drawer locking mechanism 130, and a trash level sensor 150, as shown in FIG. 1 through FIG. 3. Cabinet housing 114 is a housing, a part of the structure of checkout station 112. Cabinet housing 114 encloses drawer unit 116, trash bins 160, trash level sensor 150, and other electronics and parts of checkout station 112. Cabinet housing 114 supports register 108, light pole 174, as well as other parts of checkout station 112. Scale 106 is coupled to and mounted alongside of cabinet housing 114, in this embodiment. Cabinet housing 114 includes a cabinet side panel 118 (see FIG. 2 and FIG. 3) and a cabinet front panel 119 (FIG. 1 through FIG. 3). Cabinet side panel 118 has a cabinet side panel front edge 115, a cabinet side panel rear edge 121, a cabinet side panel top edge 198, and a cabinet side panel bottom edge 199, see FIG. 2 and FIG. 3. A cabinet side panel centerline 194 extends parallel to cabinet side panel top edge 198 halfway between cabinet side panel top edge 198 and cabinet side panel bottom edge 199. Cabinet side panel 118 also has a cabinet side panel outer surface 122 and a cabinet side panel inner surface 126, see FIG. 5 and FIG. 6.

Figure 6:
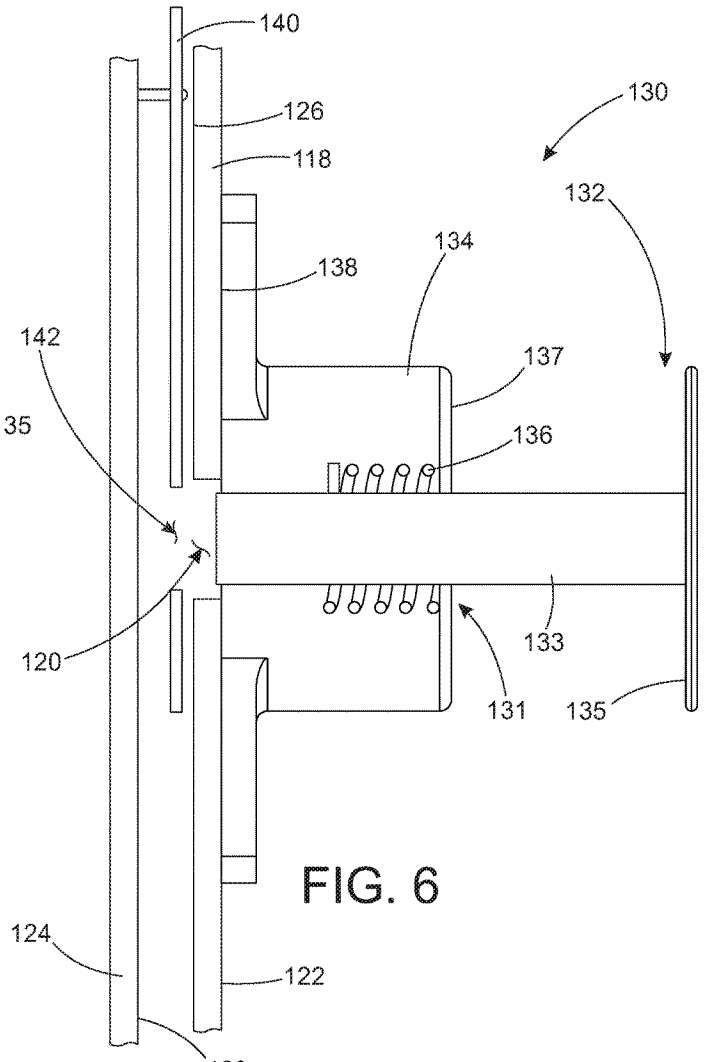
FIG. 6 shows a side view cross-section of the drawer locking mechanism of FIG. 5, with the drawer locking mechanism in the unlocked position.
Figure 5:
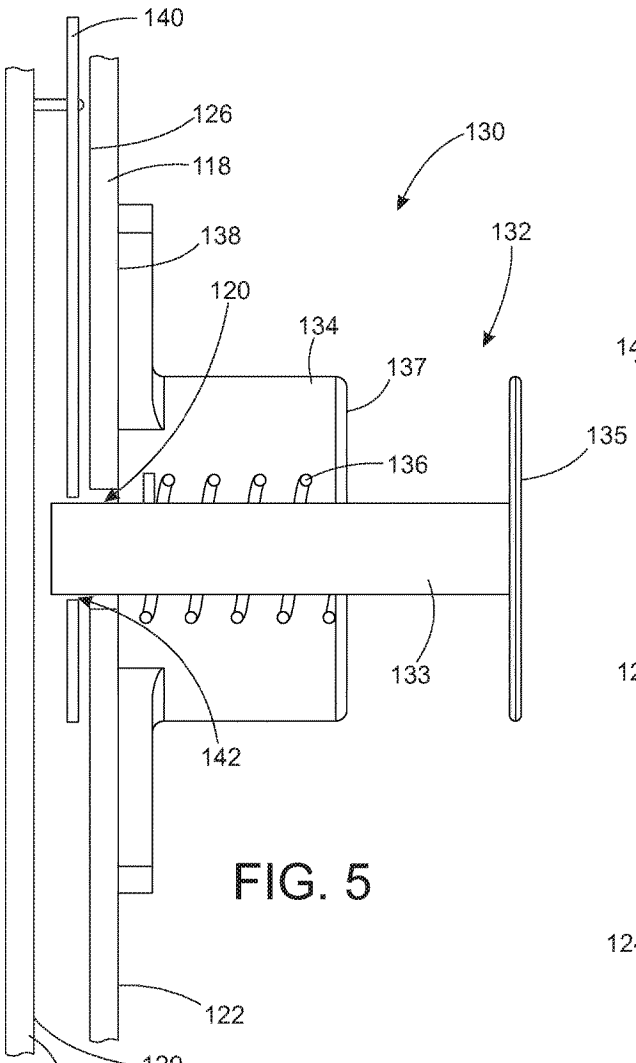
FIG. 5 shows a side view cross-section of a drawer locking mechanism of the trash bin cabinet of the checkout station of FIG. 1, with the drawer locking mechanism in the locked position.

Drawer unit 116 is a drawer structure that pulls out of cabinet housing 114, as best seen in FIG. 3. Drawer unit 116 extends out from and retracts into cabinet housing 114 along a drawer unit direction of motion 128, as shown in FIG. 3. Drawer unit 116 includes two trash bins 160 in this embodiment, as shown in FIG. 1. Trash bins 160 are contained and held by drawer unit 116 so that trash bins 160 move with drawer unit 116. Extending drawer unit 116 out from cabinet housing 114 allows trash bins 160 to be accessed, emptied, replaced, serviced, filled, or to access trash bins 160 for other reasons. Drawer unit 116 is a rectangular drawer that pulls out from cabinet housing 114. Drawer unit 116 has a bottom panel, a front panel, two side panels including drawer unit side panel 124 shown in FIG. 3, and another drawer unit side panel not shown, a rear panel, and an open top. Trash bins 160 are placed into drawer unit 116 through the open top. Drawer unit side panel 124 has a drawer unit side panel top edge 123, a drawer unit side panel bottom edge 127, and a drawer unit side panel front edge 125, as shown in FIG. 3. Drawer unit side panel 124 has a drawer unit side panel outer surface 129, as shown in FIG. 3, FIG. 5, and FIG. 6.

Figure 7:
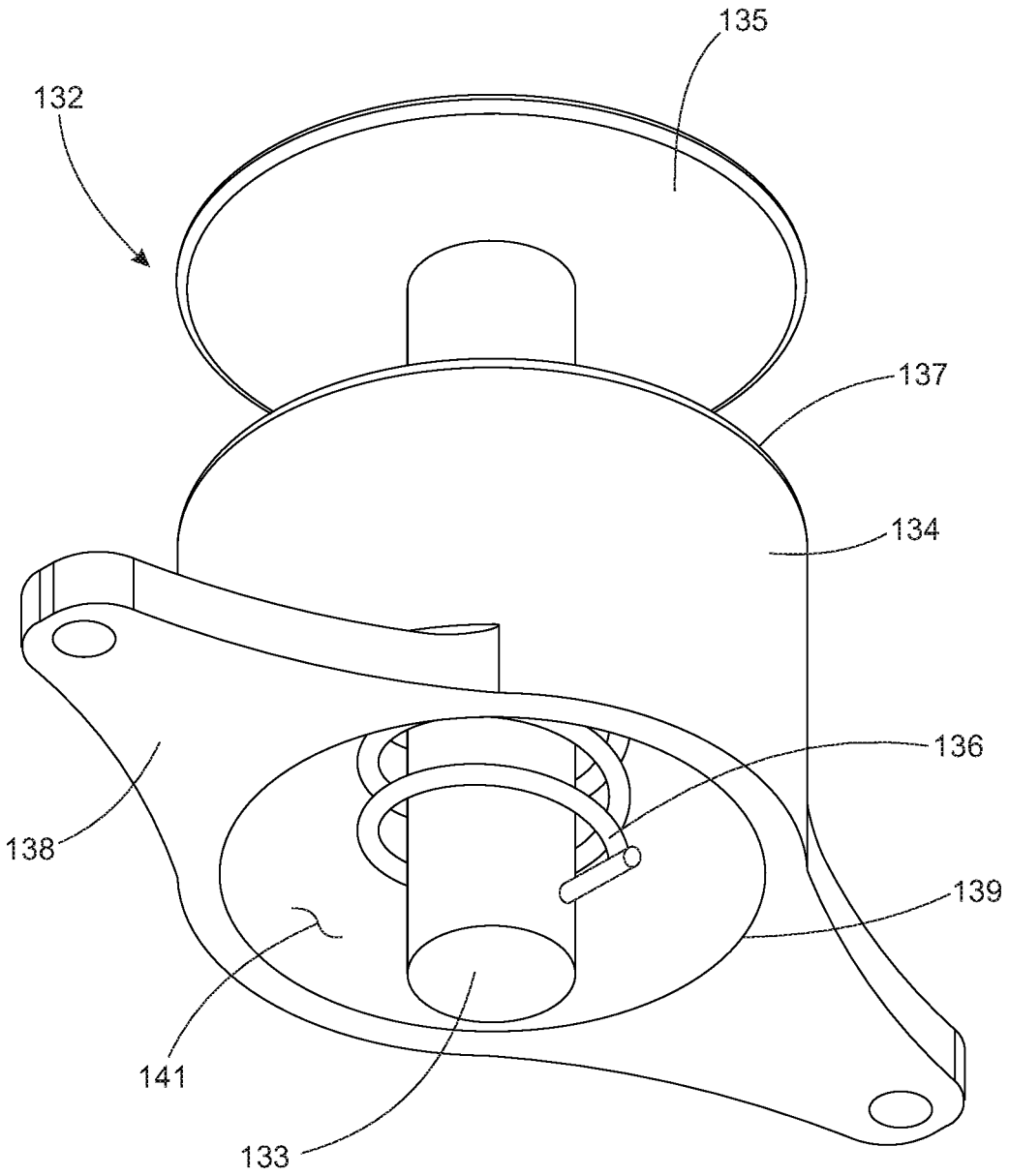
FIG. 7 shows a bottom perspective view of a pin housing, pin, and spring of the door locking mechanism of FIG. 5.
Figure 8:
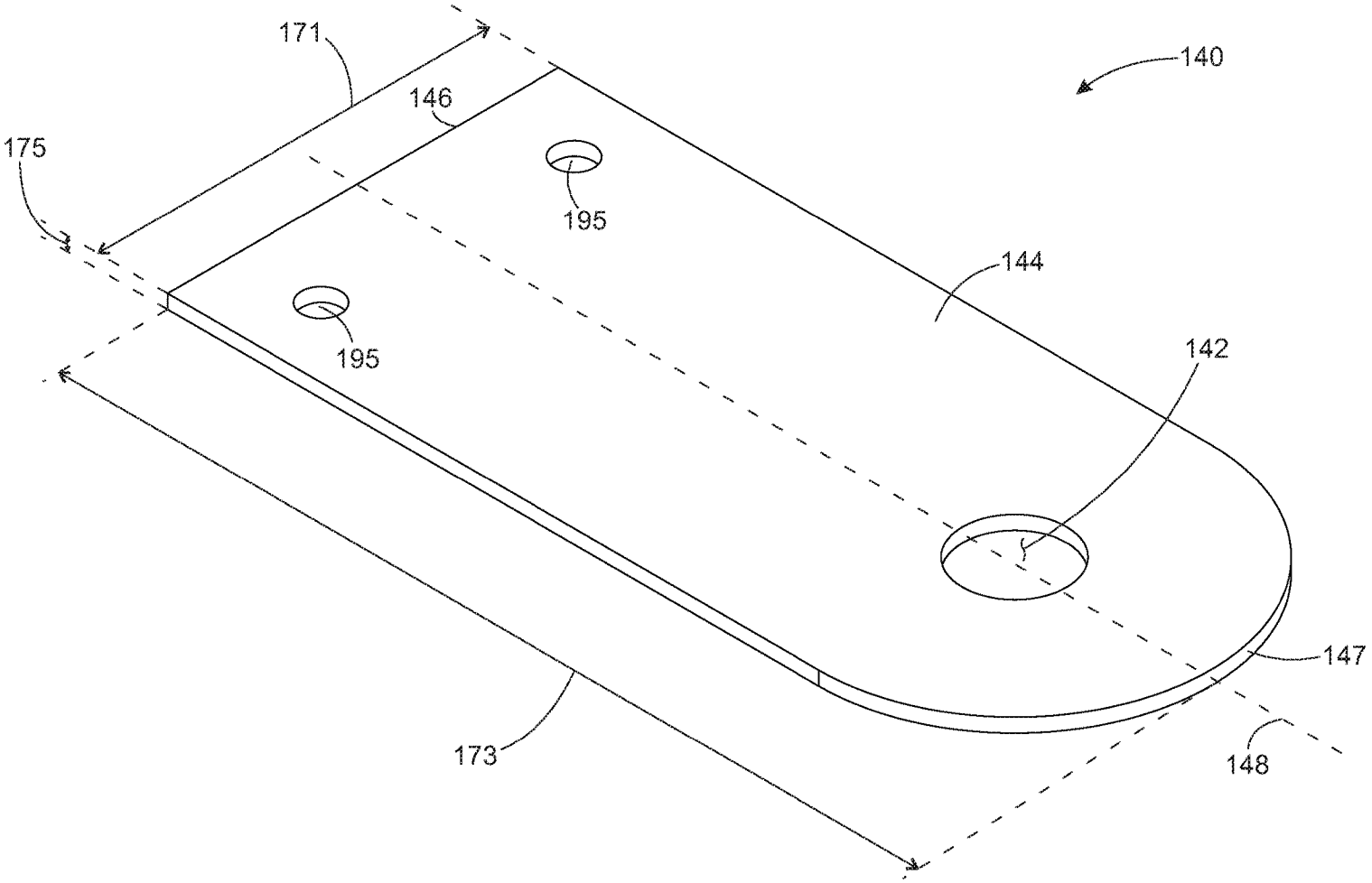
FIG. 8 shows a perspective view of an ear of the drawer locking mechanism of FIG. 5.

Trash bin cabinet 110 includes drawer locking mechanism 130. Drawer locking mechanism 130 locks drawer unit 116 closed so that drawer unit 116 does not open inadvertently. FIG. 5 and FIG. 6 show side view cutaway views of drawer locking mechanism 130 mounted to cabinet side 118 of cabinet housing 114. FIG. 5 shows drawer locking mechanism 130 in a locked state, with a pin 132 extended, and FIG. 6 shows drawer locking mechanism 130 in an unlocked state, with pin 132 retracted. FIG. 7 shows a bottom perspective view of a pin housing 134, pin 132, and spring 136 of drawer locking mechanism 130. FIG. 8 shows a front perspective view of an ear 140 of drawer locking mechanism 130.

Drawer locking mechanism 130 includes ear 140 with an ear hole 142. Ear 140 is coupled to drawer side panel 124 of drawer unit 116, as shown in FIG. 3, FIG. 5, and FIG. 6. Drawer locking mechanism 130 also includes pin 132 that is coupled to cabinet housing 114 and extends through a pin hole 120 of cabinet side panel 118. Pin 132 extends into and retracts out of ear hole 142 through pin hole 120 when pin hole 120 and ear hole 142 are lined up with each other. Drawer unit 116 is locked when pin 132 is extended through both ear hole 142 and pin hole 132, see FIG. 5. When pin retracts out of ear hole 142, drawer unit 116 is unlocked, see FIG. 6.

Ear 140 is coupled to drawer side panel 124 of drawer unit 116 as shown in FIG. 3. Ear 140 is coupled to drawer unit side panel outer surface 129. FIG. 8 shows a front perspective view of ear 140. Ear 140 is formed of a flat elongate bar 144 of rigid material, with ear hole 142 through flat elongate bar 144. A flat elongate bar in this description means a piece of material with a thickness much less than its length or width, and a length larger than its width. In this embodiment, ear 140 has an ear length 173, an ear width 171, and an ear thickness 175. Ear length 173 and ear width 171 are each more than 20 times ear thickness 175. Ear length 173 is 1.5-4 times ear width 171. In this embodiment, ear length 173 is about 2 times ear width 171. This length to width ration of 2:1 gives ear 140 strength and the ability to strongly hold drawer unit 116 locked. Flat elongate bar 144 has an ear first end 146 and an ear second end 147 opposing ear first end 146, as shown in FIG. 3 and FIG. 8. Flat elongate bar 144 has an ear longitudinal axis 148 extending longitudinally from ear first and 146 to ear second end 147. Flat elongate bar 144 has an ear hole 142 through ear 140, as shown in FIG. 8. Ear hole 142 is centered over longitudinal axis 148, closer to ear second end 147 than ear first end 146, in this embodiment. Ear 140 is coupled to drawer side panel 124 such that ear longitudinal axis 148 is collinear with cabinet side panel centerline 194 as shown in FIG. 3.

Ear 140 is coupled to drawer unit side panel outer surface 129 of drawer side panel 124 adjacent drawer unit side panel front edge 125, see FIG. 3. Ear first end 146 is coupled to drawer unit side panel outer surface 129 adjacent drawer unit side panel front edge 125 using two couplers through two coupler holes 195 through elongate bar of rigid material 144 near ear first end 146, as shown in FIG. 3 and FIG. 8. Flat elongate bar 144 is coupled to cabinet side panel 124 such that flat elongate bar 144 extends from ear first end 146 to ear second end 147 in a direction towards cabinet rear panel 121, see FIG. 3. Ear longitudinal axis 148 is parallel to drawer unit direction of motion 128. Drawer unit 116 extends out of and retracts into cabinet housing 114 along drawer unit direction of motion 128, as shown in FIG. 2 and FIG. 3. Ear 140 is coupled to drawer side panel 124 such that ear 140 is between draw side unit top edge 123 and drawer unit side panel bottom edge 127. In this embodiment an ear top distance 176 between ear side panel top edge 124 and longitudinal axis 148 is about 1/10 the size of a drawer unit side panel height 178. In other words, the ratio of ear top distance 176 to ear bottom distance 177 is 1:9, where ear bottom distance 177 is the distance between longitudinal axis 148 and drawer unit side panel bottom edge 127.

Drawer unit 116 pulls out from cabinet housing 114 through cabinet front panel 119, as shown in FIG. 3, along drawer unit direction of motion 128. Ear 140 is coupled to drawer side panel 124 so that ear 140 moves with drawer unit 116 and drawer side panel 124. Ear 140 moves with drawer side panel 124 and slides along cabinet side panel inner surface 126 of cabinet side 118 as drawer unit 116 and drawer unit side panel 124 are opened and closed (extended out from and retracted into cabinet housing 114). FIG. 2 shows drawer unit 116 in the retracted or closed position, showing trash bin 160 in dotted lines and with drawer locking mechanism 130 locked as shown in FIG. 5. Ear 140 is mounted to drawer side panel 124 so that when drawer unit 116 is closed, ear hole 142 lines up with pin hole 120, and a pin shaft 133 of pin 132 extends through both pin hole 120 and ear hole 142, as shown in FIG. 5. Drawer unit 116 is locked closed in response to pin 132 extending through pin hole 120 and ear hole 142 (FIG. 5). Drawer unit 116 is unlocked in response to pin 132 extending through pin hole 120 but not ear hole 142 (FIG. 6).

Drawer locking mechanism 130 includes pin housing 134, pin 132, and spring 136 as shown in FIG. 5, FIG. 6, and FIG. 7. Pin housing 134 encloses pin 132 and spring 136 and couples pin 132 and spring 136 to cabinet side panel 118. Pin housing 134 couples to a cabinet side panel outer surface 122 of cabinet side panel 118 of cabinet housing 114, as shown in FIG. 1 through FIG. 3 and FIG. 5 and FIG. 6. Pin housing 134 is coupled to cabinet side panel 118 over pin hole 120 (FIG. 5 and FIG. 6), so that pin 132 can extend through pin hole 120 and through ear hole 142 to lock trash bin cabinet 110. In this embodiment, pin housing 134 is coupled to cabinet side panel outer surface 122 adjacent cabinet side panel front edge 115, as shown in FIG. 2 and FIG. 3. Pin housing 134 is located along cabinet side panel centerline 194. Cabinet side panel centerline 194 is halfway between cabinet side panel top edge 198 and cabinet side panel bottom edge 199. Pin hole 120 is lined up with longitudinal axis 148 and ear hole 142 so that when drawer unit 116 is closed, ear hole 142 and pin hole 120 line up, as shown in FIG. 5 and FIG. 6. Pin housing 134 couples pin 132 and spring 136 to cabinet side panel 118. Spring 136 is enclosed in pin housing 134. Spring 136 couples pin 132 to pin housing 134.

As seen in FIG. 5 through FIG. 7, pin housing 134 is cup-shaped having a pin housing proximal side 138 mounted against cabinet side panel outer surface 122, and a pin housing distal side 137 opposing pin housing proximal side 138. Pin housing 134 also has a cavity 141, and a housing opening 139 in proximal side 138. Housing opening 139 opens proximal side 138 to cavity 141. Spring 136 is inside cavity 141. Spring 136 biases pin 132 in an extended position as shown in FIG. 5.

Pin 132 extends through distal side 137 into cavity 141. Pin 132 includes a pin shaft 133 and a pin head 135, as shown in FIG. 5 through FIG. 7. Pin shaft 133 slidably extends through a pin housing pin opening 131 in distal side 137 into cavity 141 of pin housing 134. Pin head 135 keeps pin head 135 from sliding all the way through pin housing pin opening 131. Pin shaft 133 extends through pin housing pin opening 131, through cavity 141, and through housing opening 139 in pin housing proximal side 138 when pin 132 is in an extended position. Spring 136 is coupled to pin shaft 133. Spring 136 biases pin shaft 133 so that pin shaft 133 extends out of cavity 141 past proximal side 138, as shown in FIG. 5 and FIG. 7. Pulling on pin head 135 compresses spring 136 so that pin shaft 133 is pulled back into cavity 141, as shown in FIG. 6. Releasing pin 132 extends spring 136, which extends pin shaft 133 out of cavity 141 as shown in FIG. 5 and FIG. 7. Thus, pin 132 slidably extends through pin housing 134, with spring 136 biasing pin 132 so that pin shaft 133 extends out of cavity 141. Pin shaft 133 extends out of pin housing 132 through housing opening 139 (FIG. 5) unless and until pin 132 is forceably pulled back into pin housing 134 (FIG. 6).

Pin housing 134 is coupled to cabinet side outer surface 122 so that pin shaft 133 lines up with pin hole 120 and ear hole 142 when drawer unit 116 is closed. FIG. 5 and FIG. 6 show a side view cross section of pin housing 134, pin 132, spring 136, cabinet side panel 118, and drawer side panel 124 when drawer unit 116 is in a closed position as shown in FIG. 2. Ear 140 is coupled to drawer side panel 124 so that ear hole 142 lines up with pin hole 120. Pin hole 120 and ear hole 142 are large enough for pin shaft 133 to pass through pin hole 120 and ear hole 142. Pin housing 134 is coupled to cabinet side 118 so that pin shaft 133 passes through pin hole 120 and ear hole 142 when pin shaft 133 extends out of cavity 141, as shown in FIG. 5.

Drawer locking mechanism 130 uses pin 132 to lock drawer unit 116 closed. Pin 132 is biased in the extended position by spring 136 as shown in FIG. 5. Spring 136 allows pin 132 to be retracted into pin housing 134 by pulling on pin head 135, as shown in FIG. 6. Without a force pulling pin 132 out of pin hole 120, pin 132 is in the extended position as shown in FIG. 5. Spring 136 biases pin 132 so that pin 132 is normally extended. Drawer unit 116 is locked when drawer side panel 124 is closed and pin 132 extends through pin hole 120 and ear hole 142, as shown in FIG. 5. Pulling on pin 135 unlocks drawer unit 116 by pulling pin 132 out of ear hole 142 and pin hole 120, as shown in FIG. 6. Drawer unit 116 is unlocked so that drawer unit 116 and drawer side panel 124 can be opened, as shown in FIG. 3. Pulling pin 135 away from cabinet housing 114 pulls pin 132 out of pin hole 120 and ear hole 142, as shown in FIG. 6. With pin 132 pulled out of ear hole 142 and pin hole 120 as shown in FIG. 6, drawer unit 116 is unlocked and can be opened as shown in FIG. 3.

Drawer locking mechanism 130 keeps drawer unit 116 closed and locked until a customer or employee purposely pulls pin 132 to open drawer unit 116 to access trash bins 160. Pin 132 remains in the retracted position as long as there is pressure on pin 132 pulling pin 132 out of housing 134 as shown in FIG. 6. When pin 132 is released, pin 132 extends from pin housing 134 and locks drawer unit 116 in the closed position as soon as ear hole 142 lines up with pin hole 120 so that pin 132 extends through pin hole 120 and ear hole 142, as shown in FIG. 5.

Figure 4:
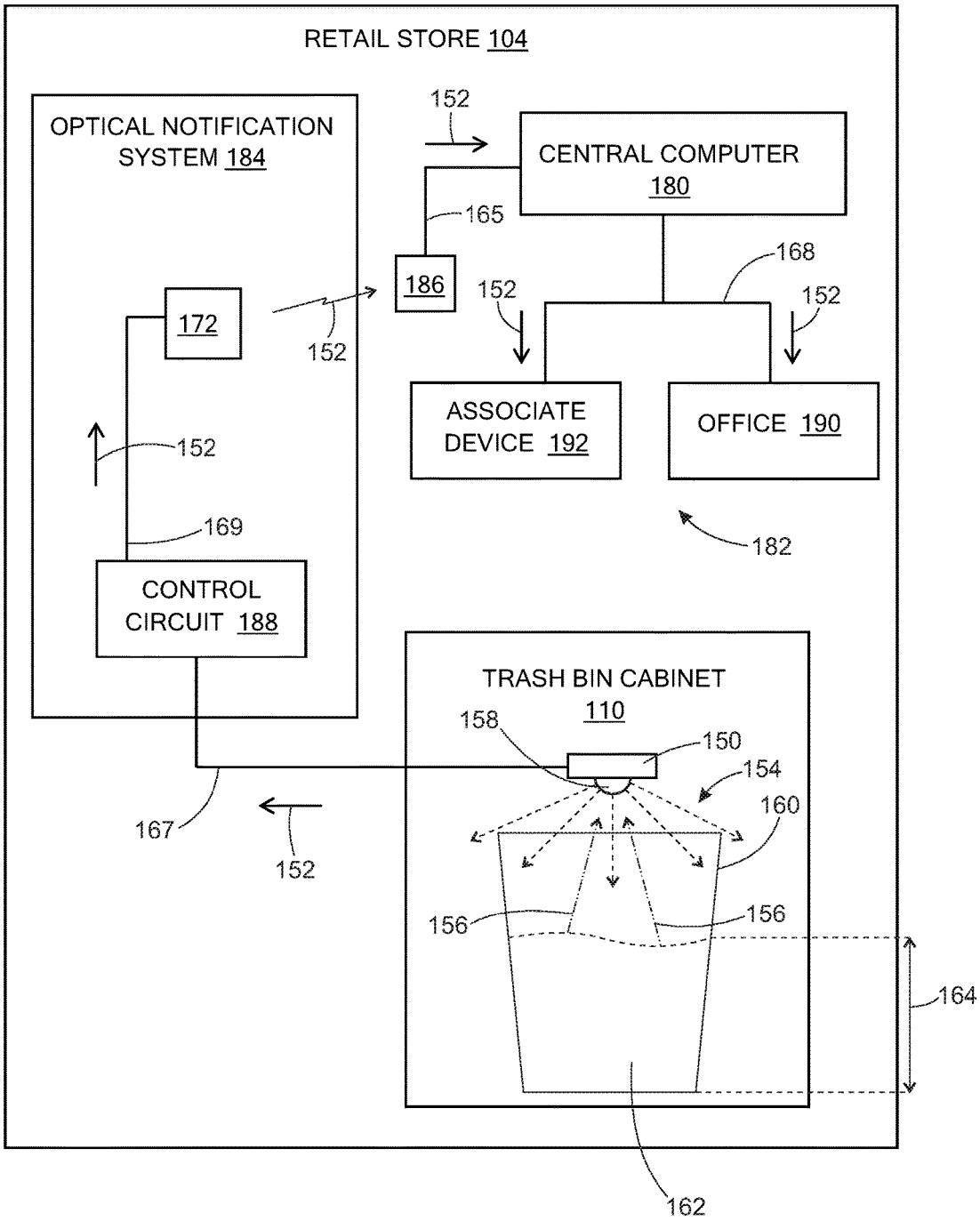
FIG. 4 shows a simplified block diagram of the trash bin cabinet and optical notification system of the checkout station of FIG. 1.

Checkout station 112 also includes optical notification system 184 and a level sensor 150, which in this embodiment is a trash level sensor 150. FIG. 4 shows a simplified block diagram of retail store 104, showing optical notification system 184, trash bin cabinet 110 with one trash bin 160, and a central computer 180. Trash level sensor 150 is mounted inside cabinet housing 114, as shown in FIG. 2, through FIG. 4. Trash level sensor 150 senses a trash level 164 (FIG. 4), and outputs a trash level status signal 152 in response. Trash level status signal 152 indicates the level of trash in trash bins 160. Optical notification system 184 receives trash level status signal 152 from trash level sensor 150, and optically radiates trash level status signal 152 using light emitter 172. It is to be understood that in some embodiments, level sensor 150 is a collectible level sensor and trash level status signal 152 is a collectible level status signal.

Trash level sensor 150 is best seen in FIG. 2, FIG. 3, and FIG. 4. Trash level sensor 150 is mounted inside cabinet housing 114 of trash bin cabinet 110. Trash level sensor 150 includes a light emitter/detector 158. Light emitter/detector 158 emits emitted light 154 as shown in FIG. 2, FIG. 3, and FIG. 4, and detects reflected light 156 as shown in FIG. 4. Emitted light 154 can be infrared light, visible, light, ultraviolet light, or light of any wavelength or combination of wavelengths. Emitted light 154 reflects off of the trash 162 in trash bin 160 and becomes reflected light 156. Trash level sensor 150 uses reflected light 156 to determine the distance between trash level sensor 150 and trash 162, as is known in the art, and uses this distance to determine trash level 164. Trash level 164 is the level of trash in trash bin 160. It is important to monitor trash level 164 so that trash bins 160 do not overflow and become messy or dangerous. Trash level sensor 150 allows trash level 164 to be monitored remotely, without requiring a person to come and look into cabinet housing 114 to determine whether trash bins 160 need to be emptied. In this embodiment, trash level sensor 150 is an infrared sensor, so emitted light 154 is infrared light.

Trash level sensor 150 senses trash level 164 in trash bin 160, and outputs trash level status signal 152 in response. Trash level status signal 152 indicates trash level 164 in one or more trash bins 160. Trash level sensor 150 is communicatively coupled to light emitter 172 of optical notification system 184 so that optical notification system 184 can communicate trash level status signal 152, allowing trash level 164 to be remotely monitored. Light emitter 172 optically radiates trash level status signal 152 so that people or sensors can detect trash level status signal 152 and determine whether trash bins 160 need to be emptied.

Trash level sensor 150 is communicatively coupled to optical notification system 184 using electrical conductor 167 in this embodiment (FIG. 4). Trash level status signal 152 is electrically conducted along electrical conductor 167 to optical notification system 184. In some embodiments, trash level status signal 152 is wirelessly or optically transmitted to optical notification system 184.

Optical notification system 184 is used to optically radiate the status of many items relating to checkout station 112. Optical notification system 184 includes pole 174, and light fixture 170, which includes light emitter 172. Light emitter 172 can emit light which is visible or non-visible, such as infrared or ultraviolet. Light emitter emits light to notify customers, employees, or optical sensors of the status of different parts of checkout station 112. Light emitter 172 can tell customers whether checkout station 112 is open or closed, for example. Light emitter 172 can tell employees that checkout station 112 needs assistance or is getting backed up. In this embodiment, light emitter 172 optically radiates trash level status signal 152. In some embodiments, light emitter 172 can indicate whether drawer unit 116 is open or closed.

Optical notification system 184 includes a control circuit 188 that receives trash level status signal 152, as shown in FIG. 4. Control circuit 188 conducts trash level status signal 152 to light emitter 172 through a conductor 169 in this embodiment. Emitter 172 optically radiates trash level status signal 152, as shown in FIG. 1 through FIG. 4. Emitter 172 can use visible light, infrared light, ultraviolet light, or any combination of wavelengths to optically radiate trash level status signal 152. In situations where a person is monitoring light emitter 172 to determine the condition of trash bins 160, light emitter 172 will emit visible light. Different wavelengths can be used to indicate that trash bins are full, empty, or in between, for example, but not by way of limitation. In the embodiment shown, trash level status signal 152 is being monitored by a central computer 180. In this embodiment, light emitter 172 uses infrared light to radiate trash level status signal 152. Trash level status signal 152 is detected by an optical sensor 186. Optical sensor 186 conducts trash level status signal 152 to central computer 180 using a conductor 165 in this embodiment. Central computer 180 sends trash level status signal 152 to at least monitoring station 182. In this embodiment, central computer 180 sends trash level status signal 12 to an associate device 192 and an office 190 using a conductor 168. In some embodiments, central computer 180 sends trash level status signal 152 to at least one monitoring station 182 using wireless or optical communication, or other forms of communications.

Associate device 192 is a computer or a mobile device carried by an employee of retail store 104. Associate device 192 is used by the employee to monitor trash level status signal 152 to determine if trash bins 160 need to be emptied. Because trash level status signal 152 is received and displayed by associate device 192, the employee of retail store 104 does not need to visit checkout station 112 to determine the condition of trash bins 160. Similarly, office 190 receives trash level status signal 152. Trash level status signal 152 can be displayed or transmitted inside office 190 to inform employees or managers whether trash bins 160 need attention.

Figure 9:
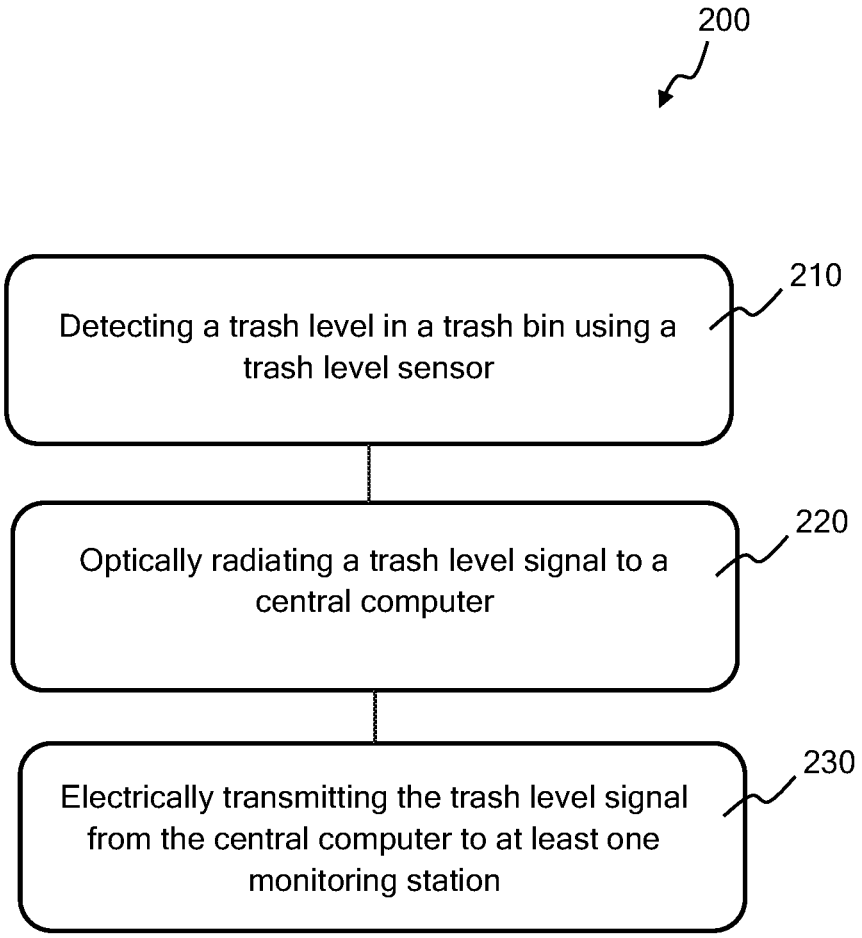
FIG. 9 illustrates a method of reporting a trash level in a trash bin at a checkout station.

FIG. 9 illustrates a method 200 of reporting a trash level in a trash bin at a checkout station in a retail store. Method 200 includes an act 210 of detecting the trash level in the trash bin using a trash level sensor. The trash level sensor can be an optical sensor. In some embodiments, act 210 of detecting the trash level using the trash level sensor includes emitting light inside a trash bin cabinet with a light emitter/detector. In some embodiments, act 210 of detecting the trash level using the trash level sensor includes detecting reflected light with the light emitter/detector. In some embodiments, act 210 of detecting the trash level using the trash level sensor includes using the reflected light to determine the trash level in the trash bin.

Method 200 also includes an act 220 of optically radiating a trash level status signal to a central computer. In some embodiments, the trash level status signal is conducted to an optical notification system that includes a light emitter. In some embodiments, optically radiating the trash level signal to the central computer includes optically radiating the trash level signal using the light emitter. In some embodiments, a trash level status signal is optically radiated with infrared light. In some embodiments, the trash level status signal is optically radiated with visible light. In some embodiments, the trash level status signal is optically radiated with a combination of visible and invisible light. In some embodiments, optically radiating the trash level signal to the central computer includes detecting the trash level signal with an optical sensor coupled to the central computer. In some embodiments, optically radiating the trash level signal to the central computer includes conducting the trash level signal from the optical sensor to the central computer.

Method 200 also includes an act 230 of electrically transmitting the trash level status signal from the central computer to at least one monitoring station. The monitoring stations can be mobile devices or displays that are used by a person or a computer to monitor the status of the trash bins at the checkout station without visiting the checkout station.

Figure 10:
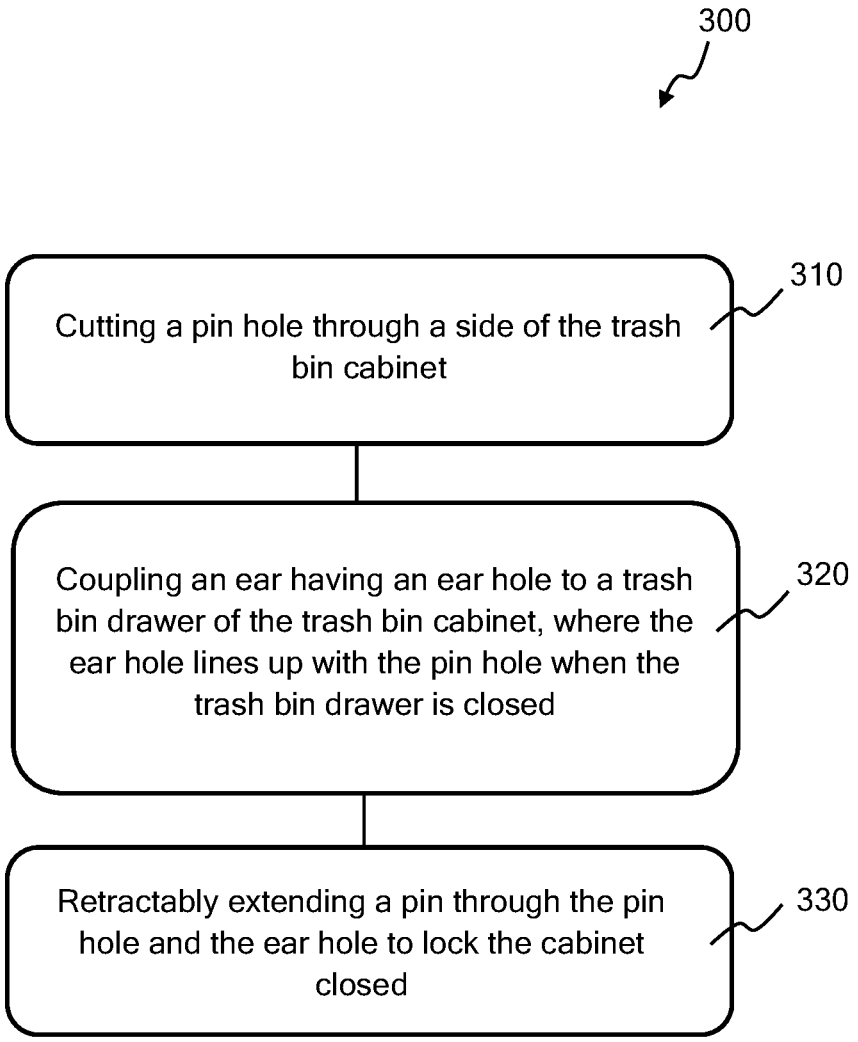
FIG. 10 illustrates a method of locking a trash bin cabinet at a checkout station.

FIG. 10 illustrates a method 300 of locking a trash bin cabinet at a checkout station. Method 300 includes an act 310 of cutting a pin hole through a side of the trash bin cabinet. The trash bin cabinet is a part of the structure of the checkout station. Method 300 includes an act 320 of coupling an ear having an ear hole to a drawer unit of the trash bin cabinet. The drawer unit of the trash bin cabinet pulls out from the cabinet housing and holds at least one trash bin. The ear is coupled to the drawer unit such that the ear hole lines up with the pin hole when the trash bin drawer unit is closed. The ear moves with the drawer unit, sliding along an inner surface of the trash bin cabinet as the drawer unit is opened and closed.

Method 300 also includes an act 330 of retractably extending a pin through the pin hole and the ear hole to lock the trash bin drawer unit in a closed position. Act 330 of retractably extending a pin through the pin hole and the ear hole includes coupling a pin housing, a spring, and the pin to an outer surface of the trash bin cabinet. The pin housing encloses the spring. The pin extends into the pin housing and is coupled to the spring. The spring biases the pin such that the pin extends out a bottom of the pin housing through the pin hole until a force is put on the pin to pull the pin back into the pin housing.

A trash bin cabinet for a checkout station in a retail store has been shown and described. The checkout station includes the trash bin cabinet with a drawer locking mechanism, and a trash level sensor with an optical notification system. The trash bin cabinet has a drawer unit that includes at least one trash bin. The drawer locking mechanism locks the drawer when the drawer is closed so the drawer unit does not come open by itself and become a hazard or a nuisance. The trash level sensor senses the level of trash in the trash bins and sends a trash level status signal to the optical notification system. The optical notification system optically radiates the trash level status signal so people or sensors can monitor the level of trash in the trash bins without visiting the checkout station. While the example embodiment described herein describe trash bins and a trash level sensor, it is to be understood that the bins may collect other items and collectibles other than trash, such as hangers, recyclables, boxes, etc. The trash level sensor may be a collectible level sensor that senses the level of the collectibles instead of the level of trash in the bins.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A trash bin cabinet for a checkout station in a retail store, the trash bin cabinet comprising:

a cabinet housing having a cabinet side panel and a cabinet front panel;

a drawer unit that extends out from and retracts into the cabinet housing, wherein the drawer unit comprises at least one trash bin; and a drawer locking mechanism comprising:

an ear coupled to the drawer unit, wherein the ear is formed of a flat elongate bar of rigid material comprising:

an ear first end, wherein the ear first end is coupled to a drawer unit side panel adjacent a drawer unit side panel front edge;

an ear second end opposing the ear first end;

an ear hole through the flat elongate bar of rigid material; and a longitudinal axis extending from the ear first end to the ear second end, wherein the longitudinal axis is parallel to a drawer unit direction of motion; and a pin coupled to a cabinet side panel outer surface, wherein the pin retractably extends through a pin hole in the cabinet side panel;

a pin housing coupled to the cabinet side panel outer surface, wherein the pin housing couples the pin to the cabinet side panel; and a spring enclosed in the pin housing, wherein the spring retractably couples the pin to the pin housing;

wherein the drawer unit is locked closed in response to the pin extending through both the pin hole and the ear hole.

2. The trash bin cabinet of claim 1, wherein the spring biases the pin in an extended position.

3. The trash bin cabinet of claim 2, wherein the pin housing is coupled to the cabinet side panel outer surface adjacent a cabinet side panel front edge.

4. The trash bin cabinet of claim 3, wherein the pin housing is coupled to the cabinet side panel approximately halfway between a cabinet side panel top edge and a cabinet side panel bottom edge.

5. The trash bin cabinet of claim 4, wherein the pin housing is cup-shaped having a pin housing proximal side mounted against the cabinet side panel outer surface, a pin housing distal side opposing the pin housing proximal side, and a cavity facing the cabinet side panel, wherein the spring is inside the cavity.

6. The trash bin cabinet of claim 5, wherein the pin comprises a pin head and a pin shaft, and wherein the pin shaft extends through a pin housing opening in the pin housing distal side, a housing opening in the pin housing proximal side, the pin hole in the cabinet side and the ear hole, in response to the spring biasing the pin in the extended position.

7. The trash bin cabinet of claim 1, wherein the drawer unit extends out of and retracts into the cabinet housing through the cabinet front panel.

8. The trash bin cabinet of claim 1, wherein the flat elongate bar extends from the ear first end to the ear second end in a direction towards a cabinet rear panel.

9. The trash bin cabinet of claim 1, wherein the drawer unit is unlocked in response to the pin extending through the pin hole and not extending through the ear hole.

10. The trash bin cabinet of claim 1, wherein the ear first end is coupled to a drawer unit side panel outer surface.

11. The trash bin cabinet of claim 10, wherein a distance between the ear longitudinal axis and a drawer unit side panel top edge is about 1/10 of a drawer unit side panel height.

12. The trash bin cabinet of claim 11, wherein the ear longitudinal axis and a cabinet side panel horizontal centerline are collinear.

13. The trash bin cabinet of claim 10, wherein the ear moves with the drawer unit side panel and slides along a cabinet side panel inner surface as the drawer unit is extended out from and retracted into the cabinet housing.

14. A trash bin cabinet for a checkout station in a retail store, the trash bin cabinet comprising:

a cabinet housing having a cabinet side panel and a cabinet front panel;

a drawer unit that extends out from and retracts into the cabinet housing, wherein the drawer unit comprises at least one trash bin; and a drawer locking mechanism comprising:

an ear coupled to the drawer unit, wherein the ear is formed of a flat elongate bar of rigid material comprising:

an ear first end, wherein the ear first end is coupled to a drawer unit side panel adjacent a drawer unit side panel front edge;

an ear second end opposing the ear first end;

an ear hole through the flat elongate bar of rigid material; and a longitudinal axis extending from the ear first end to the ear second end, wherein the longitudinal axis is parallel to a drawer unit direction of motion; and a pin coupled to a cabinet side panel outer surface, wherein the pin retractably extends through a pin hole in the cabinet side panel;

wherein the drawer unit is locked closed in response to the pin extending through both the pin hole and the ear hole; and wherein the flat elongate bar extends from the ear first end to the ear second end in a direction towards a cabinet rear panel.

15. A trash bin cabinet for a checkout station in a retail store, the trash bin cabinet comprising:

a cabinet housing having a cabinet side panel and a cabinet front panel;

a drawer unit that extends out from and retracts into the cabinet housing, wherein the drawer unit comprises at least one trash bin; and a drawer locking mechanism comprising:

an ear coupled to the drawer unit, wherein the ear is formed of a flat elongate bar of rigid material comprising:

an ear first end, wherein the ear first end is coupled to a drawer unit side panel adjacent a drawer unit side panel front edge;

an ear second end opposing the ear first end;

an ear hole through the flat elongate bar of rigid material; and a longitudinal axis extending from the ear first end to the ear second end, wherein the longitudinal axis is parallel to a drawer unit direction of motion; and a pin coupled to a cabinet side panel outer surface, wherein the pin retractably extends through a pin hole in the cabinet side panel;

wherein the drawer unit is locked closed in response to the pin extending through both the pin hole and the ear hole, wherein the ear first end is coupled to a drawer unit side panel outer surface, and wherein a distance between the ear longitudinal axis and a drawer unit side panel top edge is about 1/10 of a drawer unit side panel height.

16. The trash bin cabinet of claim 15, wherein the ear longitudinal axis and a cabinet side panel horizontal centerline are collinear.

* * * * *